United States Patent [19]

Shearer

[11] 4,158,473

[45] Jun. 19, 1979

[54] CONVERTIBLE CYLINDRICAL ELECTRICAL CONNECTOR

[75] Inventor: Jack F. Shearer, Lake Bluff, Ill.

[73] Assignee: Akzona Incorporated, Asheville, N.C.

[21] Appl. No.: 843,101

[22] Filed: Oct. 18, 1977

Related U.S. Application Data

[63] Continuation of Ser. No. 663,954, Mar. 4, 1976, abandoned.

[51] Int. Cl.[2] ..... H01R 13/42

[52] U.S. Cl. ..... 339/31 R; 339/63 M; 339/196 M

[58] Field of Search ..... 339/31 R, 31 M, 59 R, 339/59 M, 63 R, 63 M, 185 R, 186 R, 186 M, 196 R, 196 M, 206 R, 206 M

[56] References Cited

U.S. PATENT DOCUMENTS

| | | | |
|---|---|---|---|
| 3,125,395 | 3/1964 | Swanson | 339/186 R |
| 3,440,596 | 4/1969 | Frompovicz | 339/206 R |
| 3,745,512 | 7/1973 | Johnson et al. | 339/66 M |
| 3,753,212 | 8/1973 | Yamada et al. | 339/206 P |
| 3,760,336 | 3/1971 | Cerwin | 339/92 M |
| 3,885,849 | 5/1975 | Bailey et al. | 339/31 R |

FOREIGN PATENT DOCUMENTS

| | | | |
|---|---|---|---|
| 2022448 | 11/1971 | Fed. Rep. of Germany | 339/196 R |

*Primary Examiner*—Neil Abrams

*Attorney, Agent, or Firm*—Francis W. Young; David M. Carter

[57] ABSTRACT

There is provided a plastic cylindrical electrical connector including a plug and a receptacle, each having a plurality of cavities extending longitudinally therethrough. The cavities are adapted to receive a corresponding plurality of plastic modules. The modules have a plurality of holes for receiving electrical contacts. The plug and receptacle also have a plurality of holes for receiving individual electrical contacts. Each module includes at least one tab extending rearward from the module. The cavities in the plug and receptacle have at least one recess therein for securing the tab of the module and preventing the module from moving in one direction. The cavities of the plug and receptacle also include at least one shoulder to prevent the modules from moving in the other direction.

16 Claims, 5 Drawing Figures

CONVERTIBLE CYLINDRICAL ELECTRICAL CONNECTOR

This is a continuation of application Ser. No. 663,954, filed Mar. 4, 1976 now abandoned.

BACKGROUND OF THE INVENTION

This invention relates to cylindrical modular electrical connectors. More particularly, it relates to electrical connectors having a plug and receptacle with a plurality of cavities adapted to receive replaceable modules with a predetermined number of holes for receiving a predetermined number of contacts and means for securing the modules in the cavities.

Multiple contact cylindrical electrical connectors are usually constructed with a fixed number of holes through the plug and receptacle for receiving a fixed number of contacts. Once the array of holes has been constructed, the usage of that connector is more or less limited to a particular purpose. If a different pattern of holes is needed, then the connector must be redesigned and retooling for the manufacture of such a connector must be done. Even if the contacts are easily replaced, the hole positions are fixed. A large amount of inventory of connectors therefore must be maintained in order to provide the various electrical connections required. This retooling and high inventory requirement is wasteful since quite often various industries use the same size connector but different contact arrays. The differences could be the location of the contacts, the number of contacts, or the contact size needed for a particular function.

OBJECTS OF THE INVENTION

One object of the invention is to provide a cylindrical electrical connector with replaceable modules for different connector functions.

Another object of the invention is to provide an electrical connector with replaceable modules, each module having replaceable contacts.

Another object is to provide a cylindrical electrical connector having a plurality of relatively large cavities for receiving removable modules as well as a plurality of relatively small holes for receiving a plurality of electrical contacts.

Another object is to provide a plastic electrical connector having replaceable modules.

Another object is to provide an electrical connector having a plurality of cavities in its plug and receptacle for receiving a plurality of modules, the modules being extractable from the plug or receptacle in only one direction.

Another object is to provide a cylindrical electrical connector having a plug and receptacle, each having a plurality of cavities for receiving a plurality of replaceable modules, the cavities being symmetrical about a horizontal and vertical axis with respect to the faces of the plug and receptacle.

Another object is to provide an electrical connector having receptacle modules so that a single connector may be used with various modules to perform various connector functions with less need for retooling and maintenance of high inventories.

SUMMARY OF THE INVENTION

In accordance with one form of this invention, there is provided a cylindrical electrical connector having a plug and a receptacle, each having at least one cavity therethrough. At least one removable module is adapted to be received in each cavity. Each module has at least one hole therein for receiving an electrical contact. The cavity is adapted to receive various modules which may perform different electrical connector functions, whereby a single plug or receptacle may be used for a plurality of purposes.

BRIEF DESCRIPTION OF THE DRAWINGS

The subject matter which is regarded as the invention is set forth in the appended claims. The invention itself, however, together with further objects and advantages thereof may be better understood by referring to the following description taken in conjunction with the accompanying drawings in which:

DESCRIPTION OF THE PREFERRED EMBODIMENT

Figure 1:
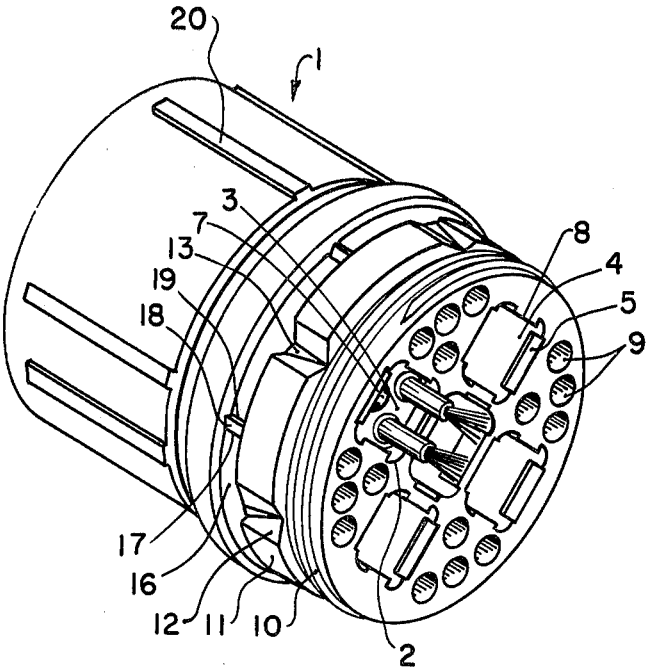
FIG. 1 is a diagram showing a perspective view of the rear of the connector plug having one module inserted in one cavity incorporating one embodiment of the present invention.
Figure 2:
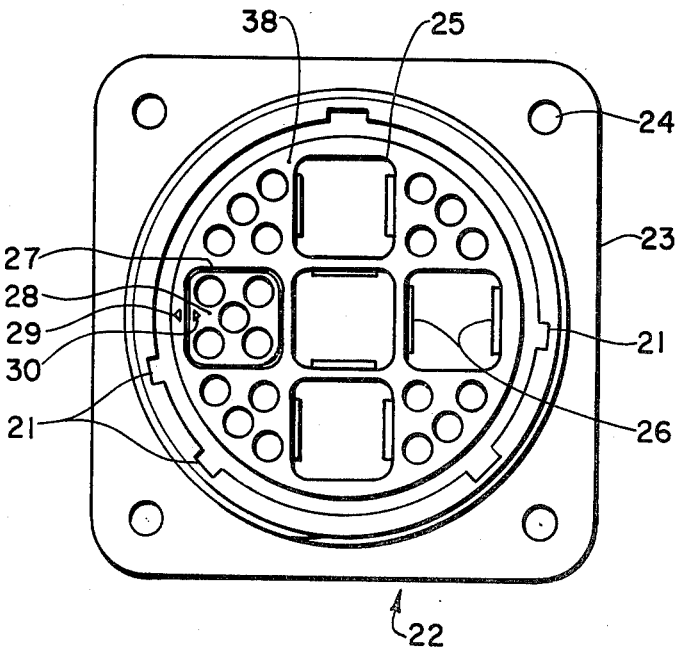
FIG. 2 is a diagram showing a front plan view of a receptacle having one module inserted incorporating one embodiment of the present invention.

Referring now more particularly to FIG. 1, there is provided a plastic connector plug 1 adapted to mate with a plastic receptacle 22 shown in FIG. 2. Plug 1, in this embodiment, has five cavities extending longitudinally therethrough. Cavity 2 is shown, in this embodiment, receiving plastic removable module 3. The other cavities, for example cavity 4, are shown to be empty and not receiving modules. In other embodiments of the invention there may be many other numbers of cavities in the connector plug and the receptacle of FIG. 2.

Cavity 4 included recess 5 for receiving shoulder 6 of tab 7 which protrudes from the rear module 3. This shoulder-recess connection is to prevent the module from sliding in the forward direction of the plug. This will be easier seen in reference to FIG. 3. Cavity 4 also has shoulders 8 which prevent the module from moving in the rearward direction of the plug.

There is further provided a plurality of holes 9 extending longitudinally through plug 1 for receiving a predetermined number of contacts. The plug further includes screw threads 10 for attaching suitable accessories such as cable adaptors and clamps. Raised portion 11 surrounds the plug and includes a plurality of wedged shaped slots 12. The bottoms 13 of these slots 12 taper up toward the front of the shell. Slots 12 are adapted to receive the non-decoupling protrusions 15 on coupling nut 14. They are tapered up at an angle so that the coupling nut positively snaps into area 16 when the coupling nut is in its final position. Area 16 includes protrusions 17 having ramps of two different steepnesses. They include ramp 18, having a gradual slope, and ramp 19, having a more steep slope. Ramp 18, having the gradual slope, would be in initial contact with protrusion 15 of coupling nut 14 in the direction of tightening the coupling nut. Ramp 19, having a steep slope, would be initial contact with protrusion 15 in the direction of loosening thus inhibiting the decoupling of the connector during vibration. This would make it more difficult to turn the coupling nut in the loosening direction as opposed to the tightening direction. Use of these ramps of two different steepnesses will cause a coupling nut to actually tighten rather than loosen during a vibration situation. This features eliminates the need for safety wiring for the connector when it is exposed to shock and/or vibration environment during its service life.

Plug 1 further has a plurality of raised rails 20 which are placed in predetermined locations along the outer circumference of the cylindrical plug in a key relation with the elongated detents 21 of receptacle 22 shown in FIG. 2. These rails and detents are arranged non-symmetrically so that the cavities which contain the modules in the plug and receptacle will align in only a single predetermined manner.

In FIG. 2 there is provided a receptacle 22 having flange 23 and mounting holes 24 for mounting the receptacle. The receptacle includes a plurality of cavities 25 which correspond to the cavities 4 shown in FIG. 1. In this embodiment four of the empty cavities 25 show the shoulders 26 which correspond to the shoulders 8 shown in the plugs 1 of FIG. 1. Again these shoulders 26 prevent the module from being moved in the direction rearward of the receptacle. The rear side of the receptacle (not shown) would also have at least one recess adjacent to each cavity to prevent the forward motion of a module as previously described in reference to FIG. 1. Cavity 27 is filled by module 28. The triangular shape markings 29 on the receptacle and markings 30 on the module 28 are provided to key the proper insertion of the modules in cavities. Furthermore, each module may be numbered to correspond with a numbered cavity on the plug or receptacle. The holes 9 and 38 may be lettered with letters corresponding on the plug and receptacle for contact alignment.

Figure 3:
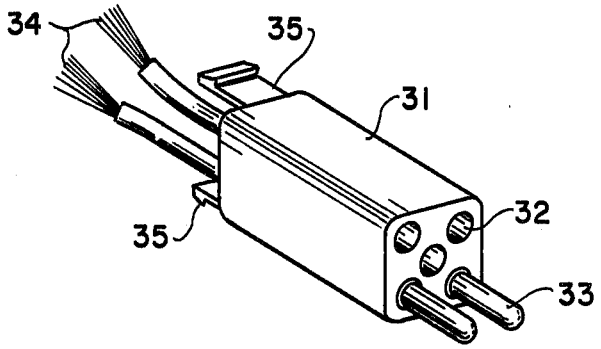
FIG. 3 is a diagram showing a front perspective view of a receptacle module incorporating other aspects of the present invention.

Referring now more particularly to FIG. 3, there is shown module 31 having five holes 32 therethrough for receiving electrical contacts which in this embodiment are male contacts 33. The rear of the male contacts are connected to wires 34 providing electrical signals to the contacts. The module includes spring biased tabs 35 extending rearwardly from the module. The tabs 35 are spring biased in that they taper away from the longitudinal axis of the modules. The relationship between the tabs and the shoulders in the cavities of the plug and receptacle may be seen more clearly in reference to FIG. 4.

Figure 4:
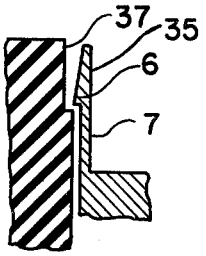
FIG. 4 is a diagram showing a tab portion of the module shown in FIG. 3 and the recess portion of a cavity shown in FIG. 1.
Figure 5:
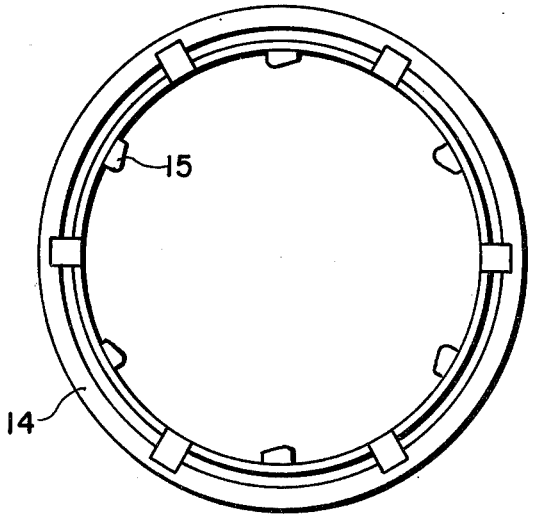
FIG. 5 is a diagram showing a side plan view of the coupling nut used to couple the plug shown in FIG. 1 and the receptacle shown in FIG. 2 together.

As can be seen in FIG. 4 tab 35 includes a shoulder 6 which snaps into recess 37 of either the plug or receptacle cavity when the module is inserted. This prevents the module from moving in the forward direction while the connector is in use. However, when it is desired to extract any module, both tabs 35 should be pressed inwardly thus freeing the shoulders 6 away from the recess 37. The module then may be pressed forward and out of the plug or receptacle.

The plug, receptacles and modules are all made of a plastic material, thus the contacts are electrically insulated from one another. The voltage levels on adjacent contacts may therefore vary be substantial amounts without fear of electrical shorts.

The openings of the cavities on both the plug and receptacle are substantially symmetrical about the horizontal and vertical axis of the front surface of the receptacle plug and receptacle; however, these cavities may be symmetrical about other axes. This symmetry allows for ease of alignment for mating respective plugs and receptacles. In this embodiment, the plugs and receptacles are a monolithic piece of plastic which is molded or preformed; however, the connector may include a core which includes the modular features set forth herein but adapted to be inserted in a connector shell.

From the foregoing description of this embodiment of the invention, it would be apparent that many modifications may be made therein. It will be understood that this embodiment of the invention is intended as an exemplification of the invention only and the invention is not limited thereto. It is to be understood, therefore, that it is intended in the appended claims to cover all such modifications which fall in the true spirit and scope of this invention.

What is claimed is:

1. An electrical connector comprising: a cylindrically-shaped plug including a front surface adapted to engage a mating receptacle; said plug including a plug rear surface, said plug having a plurality of cavities therein, said cavities being open on said front surface and said plug rear surface on said plug; at least one removable module adapted to be received in said cavities, said module having at least one hole therethrough for receiving an electrical contact; said cavities in said plug being adapted to receive various types of said module having various numbers of holes and contacts whereby a single plug may be used for a plurality of electrical connector functions; at least one recess located in each of said cavities a predetermined distance from said front surface of said plug; at least one tab protruding from the rear surface of said module for engaging said recess, thereby restricting the movement of said module towards the front of said plug; said tab being integral with said module; said tab being exposed to said rear plug surface for ease of removal of said module from said plug.

2. A connector as set forth in claim 1 further including alignment indicators on the front surface of said plug and on the front surface of said module for properly fitting and aligning said module in said plug.

3. A connector as set forth in claim 1 wherein the openings of said plurality of cavities are arranged substantially symmetrically about the horizontal and vertical axis of said front surface of said plug.

4. A connector as set forth in claim 1 wherein each of said cavities includes an opening to the rear surface of said plug, and further including at least one protruding shoulder located in each of said cavities, said shoulder being a predetermined distance from the front surface of said plug for restricting the movement of said module towards the rear of said plug.

5. A connector as set forth in claim 1 wherein said tab includes a shoulder portion extending outwardly from said tab for engaging said recess in each said cavities.

6. A connector as set forth in claim 1 further including a plurality of holes extending through said plug parallel to said cavities, each of said holes adapted to receive a single electrical contact.

7. An electrical connector comprising: a receptacle adapted to mate with a plug, said receptacle having a front surface, a rear surface, and a plurality of cavities therethrough; at least one module shaped similarly to said cavities and adapted to be received in and removed from said cavities; said module having a front surface and a rear surface and at least one hole therethrough for receiving an electrical contact wherein said receptacle may be used with a plurality of different types of module for different connector functions; means for inhibiting the movement of said module to the rear of said receptacle when said module has been inserted in said receptacle; each of said cavities being open to said front surface of said receptacle; a resilient tab integral with said module for inhibiting the movement of said module towards the front of said receptacle when said module is inserted in said receptacle, said tab projecting away from said rear surface of said module; said tab being exposed to said rear receptacle surface for ease of removal of said module from said receptacle.

8. A connector as set forth in claim 7, wherein said module is made from an electrically insulating material.

9. A connector as set forth in claim 7, wherein said receptacle is made from an electrically insulating material.

10. A connector as set forth in claim 7, wherein said means for preventing movement to the rear includes at least one shoulder in said cavity located a predetermined distance from the front surface of said receptacle.

11. A connector as set forth in claim 7 wherein said cavities are situated symmetrically with respect to the horizontal and vertical axis of the front surface of said receptacle.

12. A connector as set forth in claim 7 further including at least one hole in said receptacle located parallel to said cavities, said hole being adapted to receive an electrical contact.

13. An electrical connector comprising: a cylindrical plug and a cylindrical receptacle, each having a plurality of cavities therethrough; said plug and receptacle each having a front surface and a rear surface, said respective cavities having openings to both said surfaces; a plurality of modules adapted to be removably received in said plurality of cavities; each of said modules having a front and rear surface having at least one hole therethrough for receiving an electrical contact; tab means integral with said modules for inhibiting the movement of said modules toward the respective front surfaces; said tab means projecting away from the rear surface of said modules, and means for inhibiting the movement of said modules toward the respective rear surfaces of said plug and receptacle; said tab being exposed to said rear plug and receptacle surface for ease of removal of said module from said plug and receptacle.

14. A connector as set forth in claim 13 further including key means for aligning the cavities of said plug with the respective cavities of said receptacle.

15. A connector as set forth in claim 14 wherein said key means includes a plurality of rails located on the outer surface of said plug parallel to said plug cavities and further includes a plurality of recesses located on the inner surface of said receptacle parallel to said receptacle cavities, said rails and recesses placed in a nonsymmetrical fashion, said rails adapted to be received in said recesses.

16. A cylindrically-shaped plastic electrical connector comprising: a plug and a receptacle, each having a plurality of cavities therethrough; contact carrying removable modules received in said cavities of said plug and receptacle; each of said modules having a front and a rear surface; said cavities including a first pair of shoulders for inhibiting the movement of said modules in one direction; a pair of tabs extending from said rear surfaces of and integral with each of said modules; a second pair of shoulders extending from said tabs; a pair of recesses in said cavities for receiving said second pair of shoulders for inhibiting the movement of said modules in the other direction; a plurality of holes in said plug and receptacles substantially parallel to said cavities, said holes for receiving a plurality of electrical contacts; said tabs being exposed to said rear plug and receptacle surface for ease of removal of said module from said plug and receptacle.

* * * * *